United States Patent [19]

Totino

[11] 4,221,181

[45] Sep. 9, 1980

[54] THROAT PLATE FOR ABOVE THE BED FEED SYSTEM

[75] Inventor: Peter J. Totino, North Bergen, N.J.

[73] Assignee: The Singer Company, Stamford, Conn.

[21] Appl. No.: 45,563

[22] Filed: Jun. 4, 1979

[51] Int. Cl.[2] ..... D05B 27/00; D05B 35/00

[52] U.S. Cl. ..... 112/311; 112/310; 112/260

[58] Field of Search ..... 112/260, 258, 259, 320, 112/321, 310, 220, 311

[56] References Cited

U.S. PATENT DOCUMENTS

| | | | |
|---|---|---|---|
| 1,323,355 | 12/1919 | DeVoe | 112/260 |
| 2,207,977 | 7/1940 | Finn | 112/260 X |
| 2,580,101 | 12/1951 | Johnson | 112/260 X |
| 3,521,585 | 7/1970 | Rouha | 112/310 |
| 3,545,393 | 12/1970 | Meier | 112/260 |
| 3,808,994 | 5/1974 | Kuhn | 112/320 X |
| 3,984,745 | 10/1976 | Minalga | 112/220 X |

*Primary Examiner*—H. Hampton Hunter

*Attorney, Agent, or Firm*—Edward P. Schmidt; Robert E. Smith; Edward L. Bell

[57] ABSTRACT

A throat plate for a sewing machine having an above the bed feeding system, which throat plate provides for minimum drag on the work material. The throat plate is fashioned with a relief in which is situated a feed plate supported upon ball bearings for minimum friction, which feed plate is resiliently loaded to a central position. The throat plate is designed so that a presser foot of the above the bed feeding system will not impinge upon the movable feed plate and the feeding foot will impinge only upon the movable feed plate. Thus, work material captured between the feeding foot and the movable feed plate is not subjected to the usual drag from a stationary throat plate and, upon being released by the feeding foot, the movable feed plate returns to a starting position.

5 Claims, 7 Drawing Figures

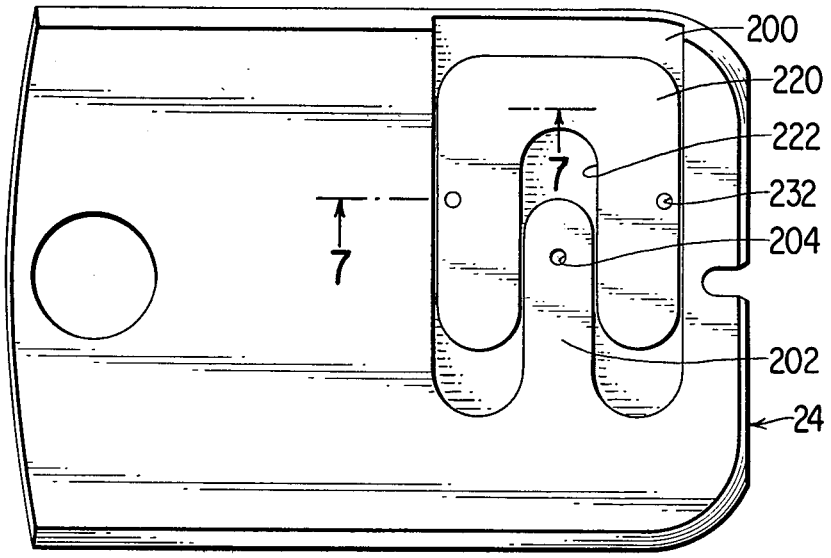
Fig. 4
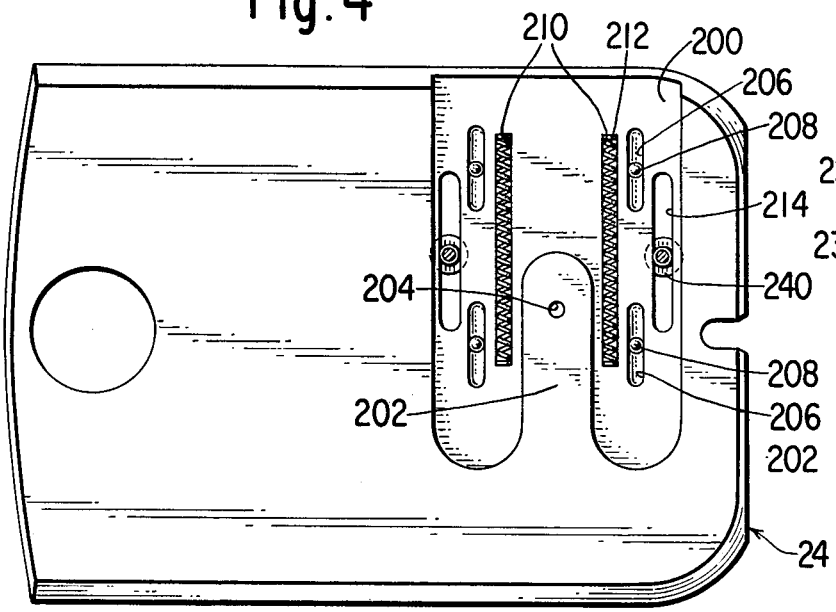
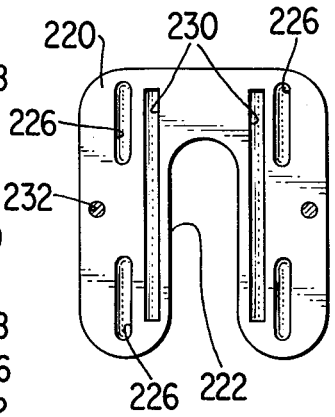
Fig. 6
Fig. 5
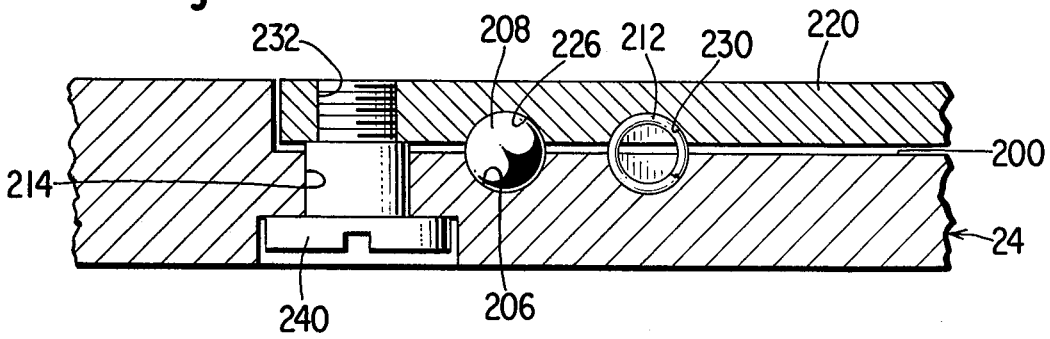
Fig. 7

THROAT PLATE FOR ABOVE THE BED FEED SYSTEM

BACKGROUND OF THE INVENTION

This invention pertains to sewing machines; more particularly, to a low friction throat plate for use in a sewing machine having an above the bed feeding system.

In the heretofore known sewing machines having above the bed feeding systems, there is provided a presser foot for clamping the work material in position against the thrust of the sewing needle and a feeding foot for moving the work material when the sewing needle is removed therefrom, the presser foot and the feeding foot operating alternately and in synchronism with end-wise reciprocation of the sewing needle. Such a device is shown in the U.S. Pat. No. 3,808,994 issued on May 7, 1974 to Kuhn.

It is also known, in bottom feed sewing machines where the material is fed through the sewing machine by a feed dog extending up through a throat plate, that the bottom piece of work material may undergo greater motion than the top piece of work material resulting in a mismatch between the materials at the end of the seam. It is easy to understand that a similar situation may ensue with a top feeding system in that drag of the lower piece of work material upon the throat plate will cause a similar problem with seam end equalization.

To combat some of the above problems, sewing machines have been produced with combined upper and lower feeds. Typically, in these sewing machines, the lower feed dog operates in opposition to the upper feeding foot, which particularly at high speed may produce a floating of the upper feed recoiling from the feed dog, whereby work material lying in between the feed dogs and feeding foot is not positively driven.

What is required in some means for efficient feeding of work material without the problems and cost attendant upon opposing feeding elements and without the drag imposed upon one ply of work material laying adjacent a static member.

SUMMARY OF THE INVENTION

A solution to the above problem is achieved in a sewing machine having an above the bed feeding system which utilizes the special throat plate of this invention. In this system the above the bed feeding system includes a presser device which impinges upon a stationary portion of a throat plate carried on the bed of the sewing machine above a looptaker, while the feeding foot rests on a low friction movable part of the throat plate. In the usual fashion a sewing needle of the sewing machine extends through a needle aperture in the throat plate while a presser foot of the above the bed feeding system presses a work material against the throat plate in the vicinity of the aperture to limit flagging and other distortion of the work material. The throat plate also carries thereupon, in a relief provided therefore, a movable insert extending partially about the needle aperture, which insert is supported upon ball bearings for low friction movement thereof and is spring loaded to return to a central position when able to engage in unrestricted motion. The ball bearings are retained in grooves in the relief in the throat plate and in the bottom of the insert. A pair of small coil springs are retained in grooves in the relief of the throat plate and in the bottom of the insert so as to maintain the insert in equilibrium in a central position permitting feed motion in a forward or reverse direction from which a return to a central position may take place.

In operation the presser foot urges a work material against a stationary portion of the throat plate whenever the sewing needle begins to penetrate, remains extended through or is withdrawing from the work material. After the sewing needle is withdrawn from the work material, the feeding foot impinges upon the insert and the presser foot is withdrawn from contact with the stationary portion of the throat plate. Thereafter the feed motion takes place by virtue of the pressure of the upper feeding foot against the movable insert of the throat plate trapping the work material therebetween, so that the work material may be transmitted without relative motion between the plies thereof. Thereafter, the presser foot again clamps the work material against the stationary part of the throat plate immediately prior to or concurrently with lifting of the feeding feet therefrom, whereupon the insert to the throat plate is returned to the central position by the springs thereof.

DESCRIPTION OF THE DRAWINGS

The novel features which are considered as characteristic for the invention are set forth in particular in the appended claims. The invention itself, however, both as to its construction and its method of operation, together with additional objects and advantages thereof will best be understood from the following description of a specific embodiment when read in conjunction with the accompanying drawings in which:

FIG. 4 is a plan of the throat plate of the invention;

FIG. 5 is a plan view similar to FIG. 4 without the insert therein to show internal details of construction thereof;

FIG. 6 is a plan view of the internal side of the insert to show details thereof; and, FIG. 7 is a cross-sectional view taken substantially along line 7—7 of FIG. 4 showing the relation of the parts thereof.

Referring to FIG. 1 there is shown the sewing machine 10 having a standard portion 12 supported on the rear thereof by rear bracket 14 and extending forwardly in a bed portion 16 which is supported by a front rail 18. A cylindrical bed 20 is formed as part of and extends from the bed portion 16 substantially parallel to the rear bracket 14. At terminus of the cylindrical bed 20 there is supported a throat plate 24.

Figure 1:
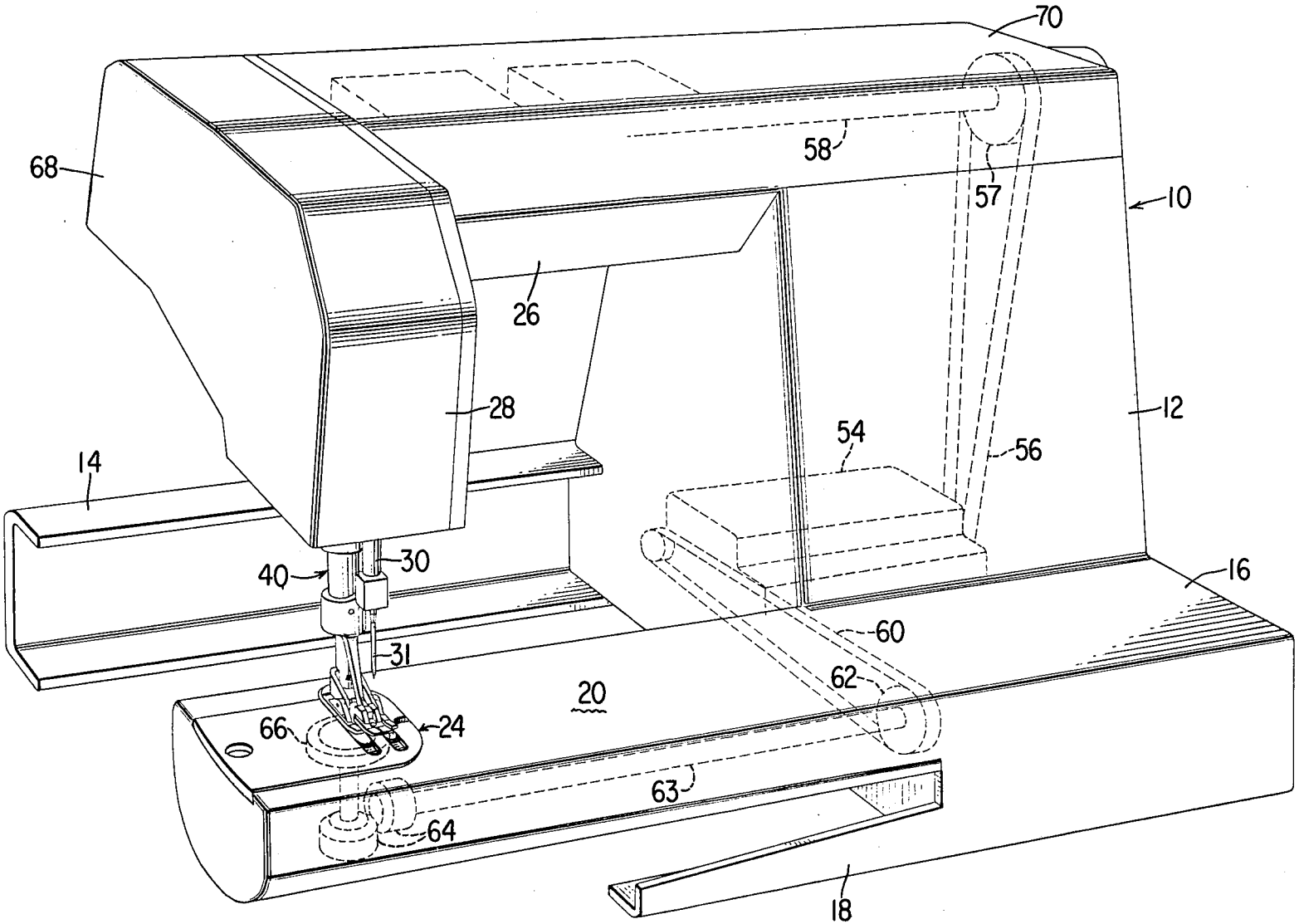
FIG. 1 is a perspective view of the sewing machine in which the invention may be utilized.

The standard portion 12 rises upwardly and supports a horizontally extending arm 26 in a direction substantially parallel to the cylinder bed 20 and rear bracket 14. A head end 28 is supported at the terminus of the arm 26, the head end extending forwardly to have a portion thereof overhang the cylinder bed 20. Supported in the head end 20 for endwise reciprocation and possible lateral oscillation, is a needle bar 30 supporting at the end thereof a sewing needle 31. Also supported in the head end 28 is a presser tube-feeding rod combination 40 which will be more fully explained below.

There is shown in phantom supported in the standard 12 a main drive motor 54 connected, by way of belt 56 and pulley 57, to horizontal arm shaft 58. A second belt 60 connects the main drive motor 54 to a pulley 62 supported on a rotating hook drive shaft 63. The rotating hook drive shaft 63 is connected by way of miter gears 64 to a rotating looptaker 66 supported in the end of the cylinder bed 20 beneath the throat plate 24. As is well known in the sewing machine art, the needle bar 30 undergoes endwise reciprocation (and may also undergo lateral oscillation) to bring the sewing needle 31 to a depressed position extending through an opening in the throat plate 24 for cooperation with the rotating looptaker 66 in the formation of stitches. The sewing machine 10 as shown in FIG. 1 is fashioned with a front cover plate 68 and a top cover plate 70 both of which may be removed to expose the inner workings of the machine.

Figure 2:
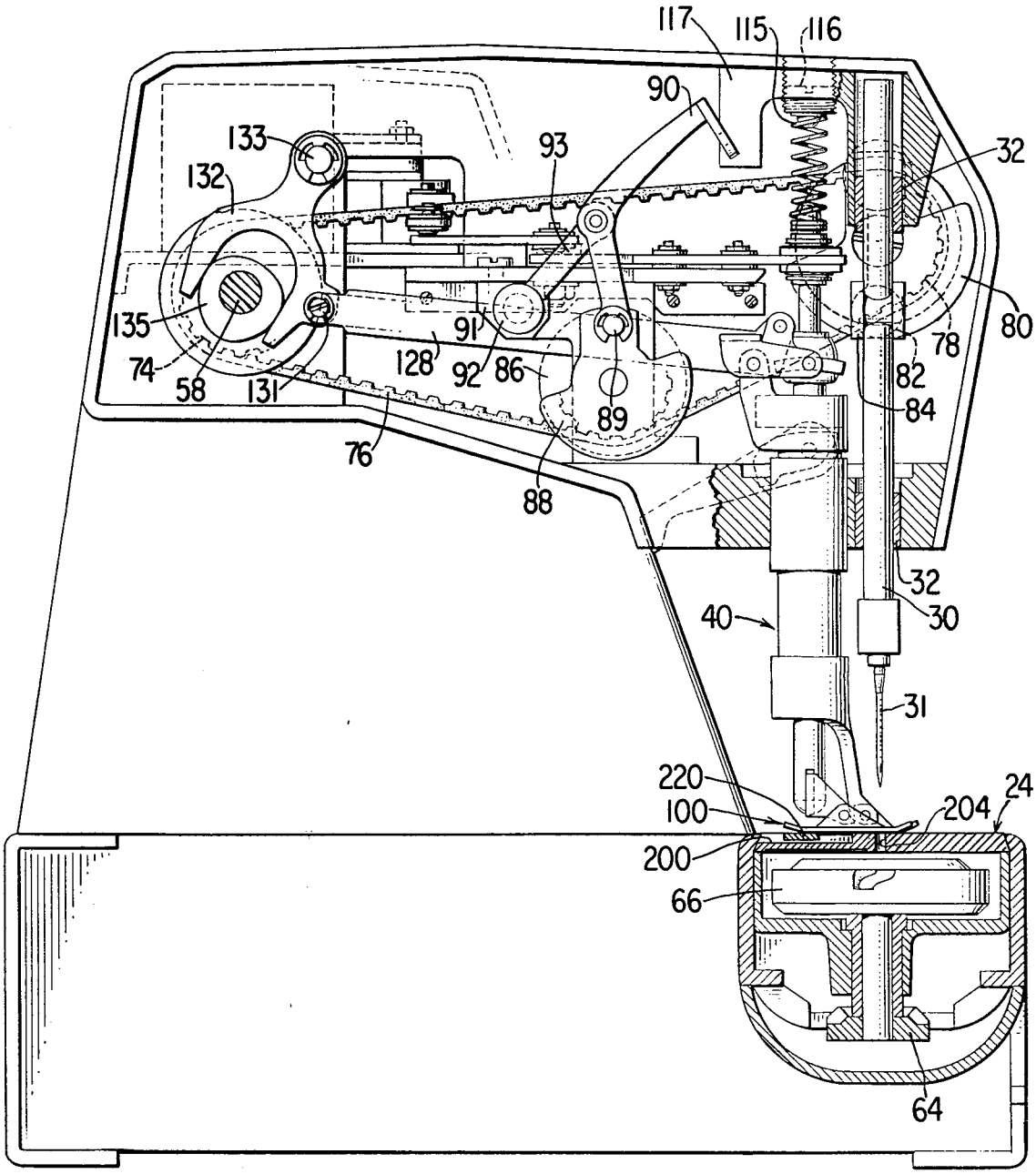
FIG. 2 is a front end elevation of the sewing machine with the cover plates removed and partially in section to show internal details of construction.

Referring now to FIG. 2 there is shown a head end elevation of the sewing machine shown in FIG. 1 with the front cover plate 68 thereof removed. Portions of the head end 28 and cylinder bed 20 were sectioned in order that greater detail might be shown. In FIG. 2 there is visible the horizontal arm shaft 58 to which there is affixed a tooth pulley 74. A belt 76 of the timing variety having teeth for meshing with teeth on the pulley 74 encircles the pulley and further encircles a second pulley 78 located adjacent the needle bar 30. The second pulley 78 is formed integrally with or connected to a crank 80, which crank is connected by way of connecting link 82 to a driving stud 84 affixed to the needle bar 30. The belt 76 passes around a third pulley 86, which third pulley is affixed to a second crank 88 which is connected by a stub shaft 89 to a takeup lever 90 pivoted on the link 93, which link oscillates on pivot 92 which is carried by the angle bracket 91. Thus, the belt 76 is driven by the horizontal arm shaft 58 to urge the needle bar 30 in endwise reciprocation and to actuate the takeup lever 90 for thread manipulating motion in cooperation with the sewing needle 31 and the looptaker 66.

It is evident from an inspection of FIG. 2 that the needle bar 30 reciprocates within bearings 32 carried within the head of the sewing machine. It will be appreciated by those of ordinary skill in the art that the needle bar 30 might be supported in a needle bar gate, which gate might be urged by an actuator into selected lateral motion in the formation of ornamental patterns. For the sake of simplicity in the present application, however, the added complexity of such an arrangement has been avoided.

Figure 3:
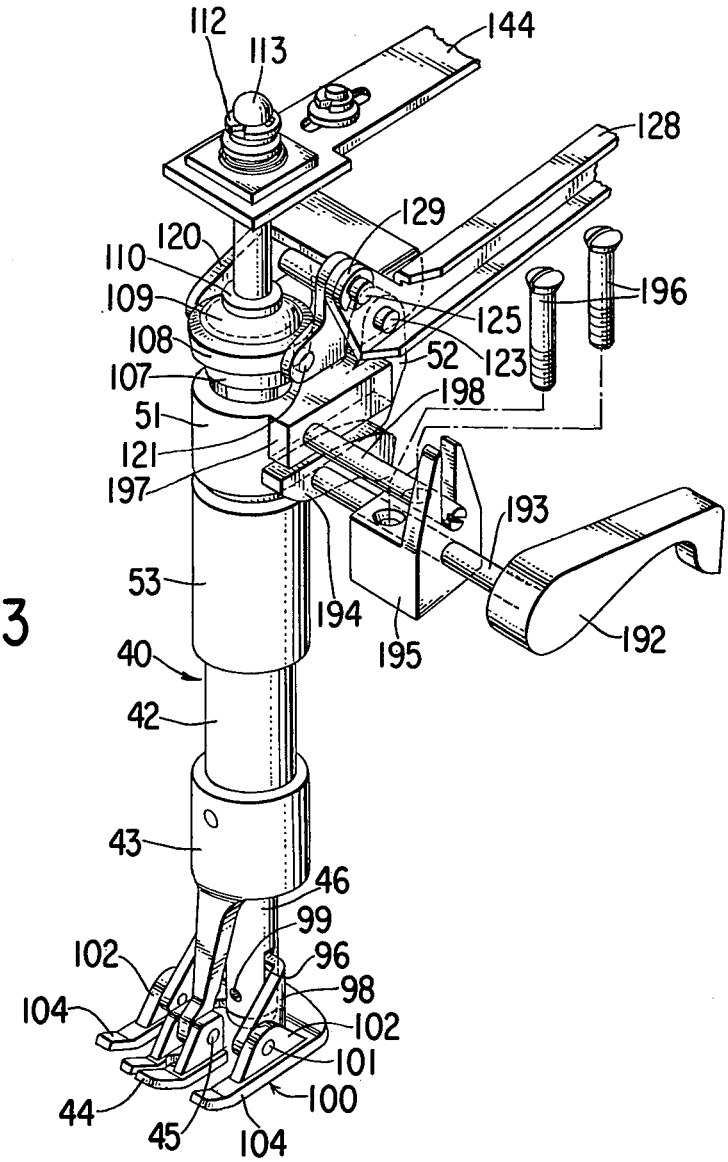
FIG. 3 is a perspective view of the presser tube and feeding rod showing in more detail the connections thereto and the action of a presser lifter thereupon.

Referring now to FIG. 3 there is shown a presser tube-feeding rod assembly 40 having as an outer portion thereto a presser tube 42 to the end of which there is affixed a presser foot 43. The sole plate 44 of the presser foot 43 is free to swivel in a fore and aft direction on a pivot pin 45. A feeding rod 46 is situated internally of the presser tube 42 and extends from both ends thereof. The feeding rod 46, in this instance, is free to swivel in a fore and aft direction and may undergo limited axial movement within the presser tube 42. On the upper end of the presser tube 42 there is situated a presser cap 51 the presser cap having laterally extending arms 52 whose purpose will be explained below. A sleeve bearing 53 is captured on the presser tube 42 between the presser cap 51 and the presser foot 43, there being provided means (not shown) for restricting motion of the sleeve bearing in the head end 28 of the sewing machine 10 so that the presser tube may partake of limited vertical motion within the bearing.

The feeding rod 46 is fashioned at the bottom end thereof with a vertical transverse slot 96. An upper bracket 98 of a feeding foot 100 is carried in the transverse slot 96 and is pivotable therein on a pin and screw 99 spanning the slot and threadedly connected to the feeding rod 46. The upper bracket 98 is fashioned with forwardly extending ears connected by swivel pins 101 to lugs 102 extending upwardly from the feeding foot sole plate 104. Thus, the feeding foot 100 is supported on the end of the feeding rod 46 freely pivotable in a forward and aft direction.

The upper end of the feeding rod 46, extending above the presser cap 51 is stepped in order to create a reduced cross section thereabove. A washer 107, preferably made of a synthetic resin having low friction characteristics, is seated on the step and has a upper surface thereof of spherical form having a radius extending from the upper surface to the swivel center of the feeding rod 46. A metal ring 108 having top and bottom surfaces of spherical shape complimentary to the spherical upper surface of the washer 107 sits above the washer, and is trapped between it and a cap 109, also preferably is made of synthetic resin having low friction characteristics. A retaining ring 110 fits into a groove (not shown) in the feeding rod 46 and retains the cap 109, metal ring 108 and washer 107 in close proximity to each other and to the step 106 in the rod. Thus, the metal ring 108 is free to move with respect to the feeding rod 46, within a specific radius of the center of the presser tube 42, as retained by the washer 107 and cap 109.

A second retaining ring 112 is formed on the top of the feeding rod 46 just beneath the rounded end 113 thereof. A compression spring 115 extends between the second retaining ring 112 and an adjustment screw 116 supported in the frame 117 of the sewing machine 10 directly above the rounded end 113 of the feeding rod 46 (see FIG. 2). The compression spring 115 is the source of the force to be applied alternately to the presser foot 43 and the feeding foot 100.

There is shown in FIG. 3 a sheet metal ternary link 120 having one swivel connection to the metal ring 108 by means of pins 121 on both sides thereof. A second connection of the ternary link 120 is made by means of pin 123 to the laterally extending arms 52 of the presser cap 51. The pins 121 and 123 are located substantially in the same horizontal plane. The third connection of the ternary link is made by the pin 125 located above and substantially between the pins 121 and 123. The pin 125 is connected by a retaining ring 129 to one end of the long link 128. The opposite end of the long link 128 is connected by pin 131 to a fork 132 pivoted on the sewing machine frame 117 on pivot pin 133 (see FIG. 2). The fork 132 spans a constant breadth cam 135 affixed to the horizontal arm shaft 58 for rotation therewith. Thus, when the constant breadth cam 135 throws the fork 132 and long link 128 in the direction of the needle bar 30, the force from the compression spring 150 passes directly through the feeding rod 46 to the feeding foot 100 since the pivot 125 of the ternary link 120 is located over the pivot 121 thereof. Simultaneously therewith, the pivot 123 of the ternary link 120 is elevated, drawing the laterally extending arms 52 and presser cap 51 to an elevated position together with a presser tube 42 and presser foot 43 attached thereto. Upon continued rotation of the horizontal arm shaft 58, the constant breadth cam 135 throws the fork 132 and long link 128 in a direction away from the needle bar 30 to a position where the pivot 125 overhangs the pivot 123 and the pivot 121 is elevated. Under these conditions the force from the compression spring 115 is fed through the pivot 121 to the pivot 123, thereby causing the presser foot 43 to be lowered into engagement with a work material and the feeding foot 100 to be elevated out of engagement therewith. Thus, force is alternately brought to bear on the presser foot 43 and the feeding foot 100.

Referring again to FIG. 3 there is disclosed a slide 144 having a connection to the upper end of the feeding rod 46. As explained above, the feeding rod 46 is capable of pivotal motion with respect to the presser tube 42 in a fore and aft direction as urged by the slide 144, which slide may receive its motion from a linear motor (not shown), either directly or through additional linkage, which linear motor may move in response to data stored in a solid state memory. Alternatively, a replaceable pattern cam may drive the slide 144 directly. For further particulars on linear motors, and circuitry for actuation thereof, the reader is referred to the U.S. Pat. No. 3,984,745, issued on Oct. 5, 1976 to Minalga which patent was assigned to the assignee of the instant application in which patent is hereby incorporated by reference herein.

Also shown in FIG. 3 are details of the presser lifter arrangement for the sewing machine 10. A presser lifter lever 192 is connected by way of a shaft 193 to cam 194. The shaft 193 is journalled in a guide block 195 which is affixed to the sewing machine frame by screws 196. The presser cap 51 is fashioned with a shoulder 197 which the cam 194 operates against to raise the presser tube-feeding rod assembly 40 when the pressor lifter lever 192 is rotated by a sewing machine operator. A guide pin 198 carried by the presser cap 51 extends into guide slots 199 formed as part of the guide block 195 in order to maintain alignment of the feed 43, 100 upon returning to a lowered position.

There has been disclosed thus far herein a sewing machine having an upper feed system which may feed work material in a fore and aft direction in the plane of the bed thereof. A feeding rod arrangement is supported coaxially with a presser bar, and means are provided to alternate pressure on the pressure bar and feeding rod. Also means are provided to move the end of the feeding rod opposite the feeding foot so as to manipulate the feeding foot a selected distance in a selected fore or aft direction. There is as disclosed means for manipulating the end of the feeding rod a desired magnitude in a selected direction. This particular construction enables the utilization of an extremely narrow cylinder bed within which there need only be supported a looptaker.

Referring now to FIG. 4 there is shown these specific throat plates 24 which may be utilized with the above sewing machine in order to provide low friction feeding of work material without incurring the problems causing non-equalization of seams. The throat plate 24 is formed with an undercut area 200 which straddles a peninsula 202 at the end of which there is the needle aperture 204 to permit passage of the sewing needle 31 to the looptaker 66. The undercut 200 of the throat plate 24 is partially filled with an insert 220 which is slotted as at 222 to accommodate the peninsula 202. Dimensionally, the peninsula 202 of the throat plate 24 is fashioned at least as wide as the presser foot 44 in order to accept the presser foot within its confines when it is lowered into engagement with the work material in order to support the work material against the thrust of the sewing needle 31. Similarly, the insert 220 is of a size to accommodate the feeding foot 100 when a feeding motion is to take place. Thus, the feeding foot does not impinge upon the peninsula 202 of the throat plate 24, nor does the presser foot 44 impinge upon the insert 220. Also, the insert 220 is dimensioned to slide freely fore and aft in the undercut area 200.

Referring now to FIG. 5 there is shown a view of the throat plate 24 with the insert 220 separated therefrom. Thus has been made visible the four short grooves 206 running, two each, down the middle of each leg of the undercut 200 equidistant on both sides of the needle aperture 204 and the peninsula 202. The short grooves 206 approach a semi-circle in cross section and each groove receives a ball bearing 208 which rolls freely from one end to the other of the short groove. Adjacent the short grooves 206, and the peninsula 202, there are situated spring grooves 210, each extending almost as far as two short grooves. Small compression springs 212 are carried in the spring grooves 210, extending from end to end of the grooves. On the side of the short grooves 206 opposite the spring grooves 210 there are situated slots 214 for a purpose of which will be explained later.

Referring to FIG. 6 there is shown the insert 220, which insert is fashioned with corresponding short grooves 226, which corresponding grooves are situated to overlie the short grooves 206, and to rest upon the ball bearings 208. Also spring grooves 230 are provided in the insert 220, the spring grooves corresponding to the spring grooves 210 in the undercut area 200 of the throat plate 24. Lastly, there are provided tapped holes 232 extending through the insert 220.

Referring now to FIG. 7 there is shown a cross section taken along line 7—7 of FIG. 4 to show the throat plate 24 in the vicinity of the undercut 200 with the insert 220 in position; and to show the ball bearing 208 in the short groove 206, 226 of the throat plate and insert respectively, and the compression spring 212 in the spring groove 210, 230 of the throat plate and insert, respectively, and the slots 214 in the throat plate 34, through which by way of example, a shoulder screw 240 may extend into the tapped hole 232 in the insert 220. In this fashion, the insert 220 may be firmly attached to the throat plate 24 while permitting free motion between the insert and the throat plate on the ball bearings 208. Any motion of the insert 220 relative to the throat plate 24 will load the compression springs 212 in a fashion to urge the insert back to the starting position when the displacing force is removed therefrom. The shoulder screws 240 may be replaced with shouldered rivets or other fastening scheme which will retain the parts together but allow free motion on the ball bearings 208.

Thus, it is apparent that a work material supported on the throat plate 24 may have the presser foot 44 impinge thereupon, pressing the work material against the peninsula 202 and supporting the work material against the thrust of the sewing needle 31 passing through the work material and the needle aperture 204 in the throat plate. After the sewing needle 31 has been removed from the work material the feeding foot 100 may be urged against the insert 220 and the presser foot 44 may be removed from the peninsula 202 of the throat plate 24, whereupon the feeding foot 100 may be urged to a new position together with the insert 220 and the work material trapped between the feeding foot and the insert, in a relatively frictionless fashion while exerting little or no drag on the work material. Thereafter the work material may once again be clamped by the presser foot 44, and the feeding foot may be removed from the insert 220, thereby permitting the insert to return to its center position under the influence of the compression springs 212.

Having thus set forth the nature of the invention what is sought to be claimed is:

1. A sewing machine having a frame including a bed, a standard rising from said bed, a bracket arm supported by said standard overhanging said bed, said bed supporting internally thereof a looptaker, said bracket arm supporting an endwise reciprocating sewing needle and an above the bed feeding system having means for alternately clamping the work material against the thrust of the sewing needle and for unclamping and feeding the work material, said sewing needle cooperating with said looptaker in the formation of stitches; the improvement which comprises:

a throat plate having an aperture for permitting passage of said needle to said looptaker, a portion of said throat plate surrounding said aperture receiving the thrust of said work clamping means, and a feed plate movably supported by said throat plate for receiving the thrust of said work material feeding means.

2. A sewing machine as claimed in claim 1 wherein said improvement further comprises:

means for resiliently urging said feed plate to a fixed position on said throat plate, whereby said feed plate may be urged by said work material feeding means against the urging of said resilient urging means, and said feed plate will return to said fixed position when said work material clamping means alternate with said work material feeding means, thereby freeing said feed plate from the restrain of said work material feeding means.

3. A sewing machine as claimed in claim 2 wherein said fixed position to which said feed plate is urged by said resiliently urging means is a central position from which said feed plate maybe urged in a selected forward and reverse direction.

4. A sewing machine as claimed in claim 3 wherein said throat plate is fashioned with a relief for receiving said feed plate, and wherein said relief and said feed plate are fashioned with corresponding grooves in a forward and reverse direction, the improvement further comprising a plurality of balls carried at least one each in each groove of the relief.

5. In a sewing machine as claimed in claim 4 wherein said relief in said throat plate and said feed plate are further fashioned with corresponding long grooves extending in a forward and reverse direction, and wherein said resiliently urging means is implemented by coil compression springs carried in said corresponding grooves in said relief and said throat plate and said feed plate, said coil compression springs extend the length of the grooves, whereby said coil compression springs exert a restoring force on said feed plate in either direction of motion thereof.

* * * * *